US006145231A

United States Patent [19]

Valiulis

[11] Patent Number: 6,145,231

[45] Date of Patent: Nov. 14, 2000

[54] MARKETING DISPLAYS PROVIDING READY REPLACEABILITY OF ADHESIVE DISPLAY LABELS

[75] Inventor: Thomas E. Valiulis, Rockford, Ill.

[73] Assignee: Southern Imperial, Inc., Rockford, Ill.

[21] Appl. No.: 08/940,859

[22] Filed: Sep. 29, 1997

[51] Int. Cl.[7] ..... G09F 3/18

[52] U.S. Cl. ..... 40/661.03; 40/638; 40/642.01; 40/661.09; 40/594; 283/81

[58] Field of Search ..... 40/638, 642.01, 40/661.03, 661.09, 594, 595; 283/81

[56] References Cited

U.S. PATENT DOCUMENTS

| | | | |
|---|---|---|---|
| 2,563,340 | 8/1951 | Kelly | 283/81 |
| 3,912,084 | 10/1975 | Valiulis . | |
| 4,250,642 | 2/1981 | Riehle . | |
| 4,452,360 | 6/1984 | Barnes . | |
| 4,589,685 | 5/1986 | Lazar | 283/31 |
| 4,718,626 | 1/1988 | Thalenfeld et al. . | |
| 4,783,033 | 11/1988 | Valiulis . | |
| 4,787,159 | 11/1988 | Fast . | |
| 4,805,861 | 2/1989 | Thalenfeld et al. . | |
| 4,850,557 | 7/1989 | Valiulis . | |
| 4,882,868 | 11/1989 | Fast . | |
| 4,900,604 | 2/1990 | Martinez et al. . | |
| 4,976,058 | 12/1990 | Valiulis . | |
| 5,120,941 | 6/1992 | Reilley et al. | 235/375 |
| 5,135,261 | 8/1992 | Cusack et al. | 283/81 |
| 5,231,779 | 8/1993 | Valiulis et al. . | |
| 5,236,163 | 8/1993 | Valiulis . | |
| 5,248,536 | 9/1993 | Du Katz . | |
| 5,269,691 | 12/1993 | Waldman . | |
| 5,299,834 | 4/1994 | Kraige | 283/51 |
| 5,325,616 | 7/1994 | Valiulis . | |
| 5,343,647 | 9/1994 | Bulka . | |
| 5,428,914 | 7/1995 | Whitehouse et al. . | |
| 5,464,681 | 11/1995 | Luce . | |
| 5,597,634 | 1/1997 | Bloomer et al. | 428/40.1 |
| 5,628,858 | 5/1997 | Petrou | 156/249 |
| 5,639,125 | 6/1997 | Garrison | 283/81 |
| 5,672,402 | 9/1997 | Kreckel et al. | 428/34.2 |
| 5,704,650 | 1/1998 | Laurash et al. | 283/81 |
| 5,728,469 | 3/1998 | Mann et al. | 428/418 |
| 5,792,296 | 8/1998 | Soltysiak | 156/184 |

FOREIGN PATENT DOCUMENTS

| | | | |
|---|---|---|---|
| 3307694 | 9/1984 | Germany | 40/594 |

*Primary Examiner*—Terry Lee Melius
*Assistant Examiner*—Andrea Chop
*Attorney, Agent, or Firm*—Leydig, Voit & Mayer, Ltd.

[57] ABSTRACT

A marketing display device such as a shelf or a "Pegboard" type hanger is provided with an outer display panel that has a release coating, such as of silicone, for ready attachment, removal and replacement of adhesive labels that carry indicia pertinent to the marketing of products on the hangers to passing potential customers. In one preferred embodiment the release coating is carried on a liner that is adhesively attached to the shelf or hanger for such removable mounting of labels and wherein the liner, including the attaching adhesive, also is readily and cleanly removable by peeling the liner from the surface to which it is adhered.

8 Claims, 8 Drawing Sheets

MARKETING DISPLAYS PROVIDING READY REPLACEABILITY OF ADHESIVE DISPLAY LABELS

The disclosure of each of my copending applications Ser. No. 08/754,245 entitled Marketing Displays Providing Ready Replaceability of Adhesive Display Labels and Ser. No. 08/752,529 entitled Merchandise Hangers Providing Ready Replaceability of Adhesive Display Labels, both filed Nov. 20, 1996 is incorporated herein by reference.

FIELD OF THE INVENTION

This invention relates to marketing displays, such as merchandise hangers, shelving and racks.

BACKGROUND OF THE INVENTION

As is well known, a variety of hangers, shelving, racks and similar merchandise supports are used to support and display merchandise for convenient viewing and access by customers. A label support usually is provided on each merchandise support for supporting and prominently exhibiting a label or "tag" that may contain pricing, stockkeeping units and other information and indicia pertaining to the merchandise that is on display.

In such merchandise displays, it is desirable to permit ready application, removal and exchange of information labels, e.g. as in instances of changing of the products, prices, sale announcements, images which facilitate inventorying, and other pertinent information. It is further desirable to permit easy changes in the label application and support system.

OBJECTS AND SUMMARY OF THE INVENTION

The general aim of the present invention is to provide marketing displays with improved label holder arrangements that permit easy removal and replacement of adhesive labels on such displays.

A more specific object of the invention is to provide such displays and related labels which assure smooth attractive affixation of each adhesive label while also providing simple, quick and economical removal and replacement as well as exchange of the labels as marketing circumstances and product information change.

Another object of the invention is to facilitate complete removal or exchange of the components of a labelling system, such as to allow for exchange of the components or for the substitution of a different system.

These and other objects and advantages of the invention will become more apparent from the following description and the accompanying drawings.

Marketing display supports, which are designed for supporting products for selection and purchase by customers as those customers pass the supported products, are provided with a label supporting panel surface that includes an outer release layer. That release layer provides readily releasable adherent support for adhesive labels which display product information. More specifically, the release layer, which may be a thin coating of a silicone or similar material, adherently retains and supports an adhesively coated label that is pressed onto that surface and will readily release such a label, i.e. will permit the label to be peeled off cleanly with little effort, normally without tearing or splitting the label or leaving any residue therefrom on the label panel surface. Thereby labels applied to the label panel are exposed outwardly relative to the support for viewing by customers who pass by the display. The labels also are readily removable and replaceable, as well as exchangeable, by merchandising personnel as the facts and circumstances to be displayed change from time to time.

In the preferred embodiments, the release layer is affixed to the label support. One such embodiment utilizes a thin flexible liner or carrier member. This member includes a carrier body layer such as of paper or a synthetic base stock or a laminate of such stock materials and is adhered to the support surface of the label support panel in a relatively permanent manner. The release layer is provided on the outward side of the carrier body and thereby is exposed outwardly. In another preferred embodiment, the release layer is applied as a coating directly onto the label support panel. In each instance, adhesively backed labels are readily attached smoothly on the release layer and are readily and easily removable and replaceable manually by store personnel.

In a further preferred embodiment, label holding liners that are easily attached relatively permanently to merchandise supports by adhesive also are conveniently removable cleanly, to leave little or no residue on the merchandise supports, even after long periods of being so adhered to the merchandise supports. The peel strength of the bond between the liner-attaching adhesive and the carrier body of the liner as well as the tensile and tear strengths of the carrier body significantly exceed the strength of the bond of the liner-attaching adhesive to the label supporting surface of a merchandise support. The bond of the labels to the release layer is of significantly lesser strength. The bond of the release layer to the carrier body of course is sufficient to retain the release layer in place on the liner as the labels are applied and removed.

In a yet further preferred embodiment, the carrier body is formed of a laminate of two synthetic plastic materials. The material of the lamina on the carrier attachment side is selected for its ability to provide the requisite strong bond with the attaching adhesive while the lamina on the label side of the carrier body is selected for its suitability for the application of and retentive bonding with the release layer. The attaching-side lamina also preferably is opaque and readily printable. The label-side lamina and the release layer preferably are transparent. Thereby information such as advertising may be printed on the inward surface of the attaching lamina and be visible to passing customers and others through the label-side lamina and the release layer. Also, due to the opacity of the attaching-side lamina, the liner covers and hides any irregularities, prior marking, residue or other scars on the underlying support surface over which the liner is mounted.

Figure 1:
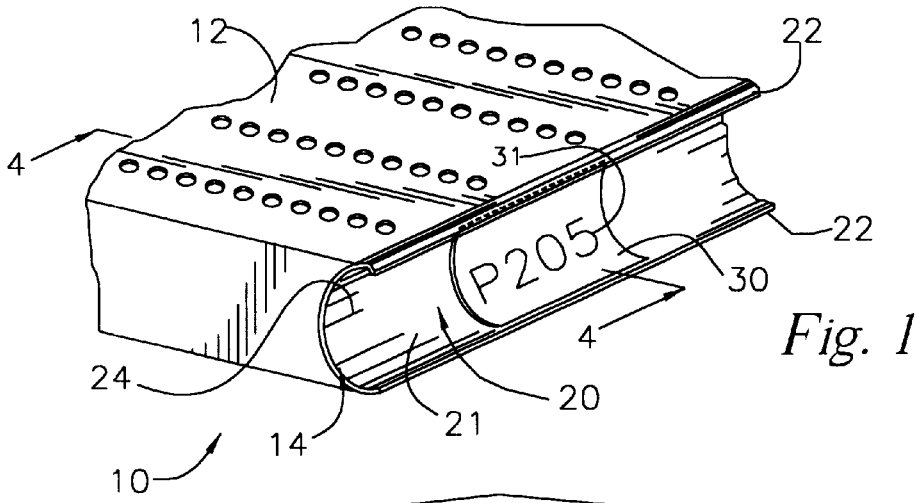
FIG. 1 is a perspective view of a typical marketing display shelf with a label support rail, which employs teachings of the present invention.

The thickness of various layers of materials and coatings are exaggerated in the various drawing figures for convenience and clarity of illustration.

While the invention is susceptible to various modifications and alternative constructions, preferred embodiments have been shown in the drawings and will be described in detail. It will be understood, however, that there is no intention to limit the invention to the specific embodiments illustrated or described herein, but on the contrary the intention is to cover all modifications, alternative constructions and methods and equivalents falling within the spirit and scope of the invention.

DETAILED DESCRIPTION OF THE PREFERRED EMBODIMENT

Figure 5:
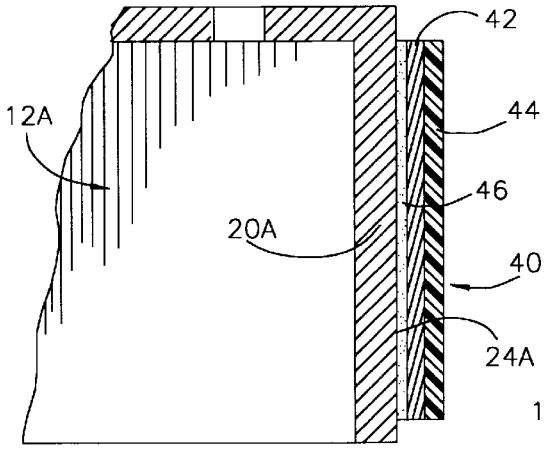
FIG. 5 is a view corresponding to FIG. 4 showing another embodiment employing teachings of this invention.
Figure 7:
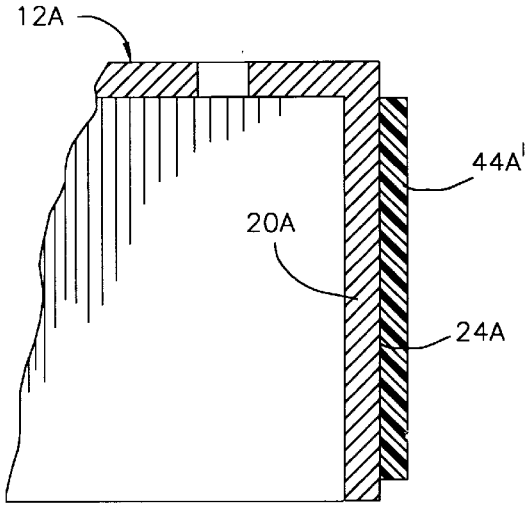

For purposes of illustration, one presently preferred embodiment of the invention is shown in the drawings in connection with a display support assembly 10. That assembly includes a shelf 12 with a conventional generally C-shaped "price channel" rail (PC Rail) 14 extending across the exposed outer edge of that shelf. Such a rail or other label panel may be affixed to the shelf as by welding or by the use of suitable fasteners or clips(not shown). Alternatively, the label panel may be a wall or surface of the basic support structure, for example an end wall or flange of the shelf such as is illustrated in FIGS. 5 and 7. The rail or other label panel serves as a support for labels 30 or other display pieces which provide readable information to passing customers and/or to merchandising personnel concerning the merchandise to be sold from the support 10.

Figure 21:
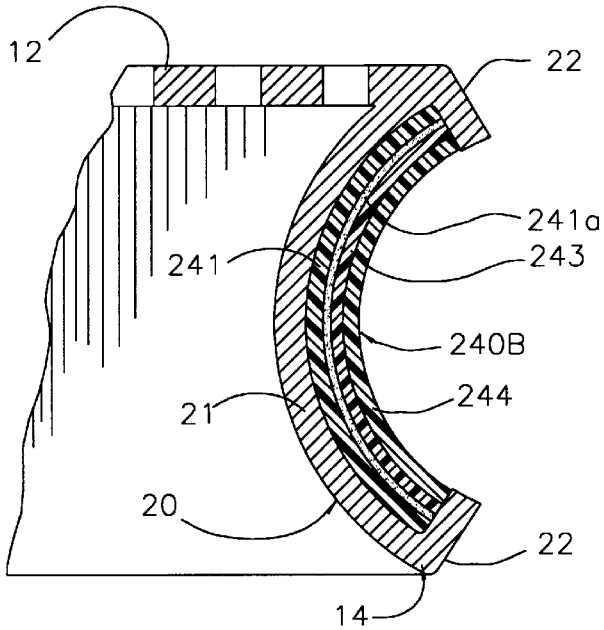
FIG. 21 is a sectional view of another embodiment employing teachings of this invention.

The rail 14 includes a generally C-shaped main body portion 20 with opposed flanges or lips 22 which extend the length of the rail at the opposite (upper and lower) edges of the C-shaped body 20. Each flange 22 is an integral extension from the body panel 21 and typically is disposed at an acute angle to the respective adjacent panel portion. The flanges 22 may serve as guides for insertion and/or retention of removable label support elements and/or labels engaged within the rail 14, for example as seen in FIG. 21. The rail 14 includes a continuous outwardly exposed panel surface 24 of a shallow concave profile between the lips 22. Labels 30 are supported in the rail over this surface 24 for display purposes. The labels 30 are printed with indicia 31 such as the identification of the products on the support adjacent the respective label, or the price, stock number, inventory indicia or other information to be read by potential customers and/or merchandising personnel concerning that product/merchandise.

Figure 3:
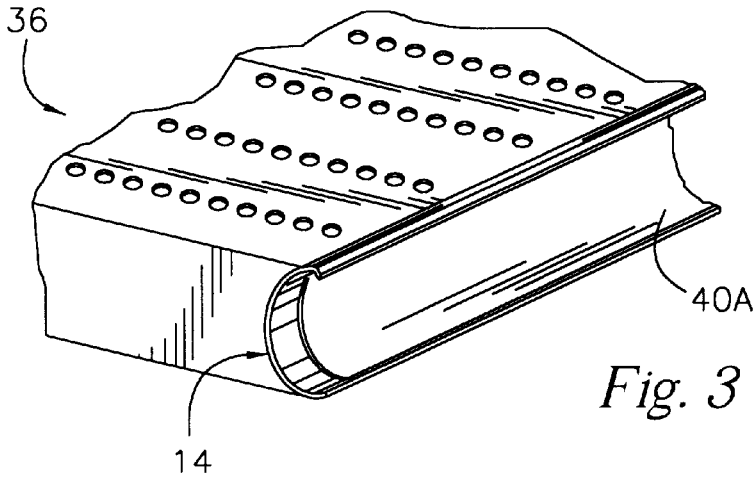
FIG. 3 is a perspective view similar to FIG. 1 and illustrating another embodiment employing teachings of this invention.

The support assembly 36 shown in FIG. 3 also comprises a support shelf and a rail 14 along the front edge of that support shelf, in the same manner as in the assembly of FIG. 1. The assembly of FIG. 3 differs from the assembly of FIG. 1 in that the embodiment illustrated in FIG. 1 contemplates applying short label holders randomly at various positions along the length of the rail. The embodiment of FIG. 3 is preferred in that it contemplates use of a strip liner 40A to provide essentially the same form of label holding capabilities continuously along essentially the entire length of the rail, that is, across essentially the full width of the shelf.

FIGS. 4–7 illustrate four embodiments for releasably and removably supporting display labels on an exposed surface of the shelf. Each embodiment presents a label support surface formed by a release coating 44, 44A, 44A' to facilitate the removal and replacement of synthetic or paper adhesive labels. In each instance, when an adhesive label is applied to the release layer, the label will not slide or fall off. However, when it is desired to remove a label, that label may be peeled off with little effort, normally without tearing or delaminating the label and leaving no residue from the label on the support surface.

More particularly, in FIGS. 1–5, a label release liner or carrier 40 includes a carrier body 42 with a release coating 44 on its outer side. A layer of adhesive 46 attaches the carrier 40 relatively permanently to the respective label support panel, e.g., to the surface 24 of the rail 14 of the shelf 12 or to the generally planar end panel surface 24A of the end flange 20A on the shelf 12A in FIG. 5. In the illustrated embodiment, the carrier body 42 is a thin flexible sheet of paper or synthetic material which carries the adhesive layer or coating 46 on one side and the release coating or layer 44 on the opposite side. The release layer 44 preferably is a thin coating of a silicone resin or similar material which will retain a flexible adhesively backed label smoothly and uniformly on the label support plate without sliding or falling off. Thereby, indicia 31 will be correctly and pleasingly presented to customers who are passing and have access to the merchandise on the hangers.

Figure 2:
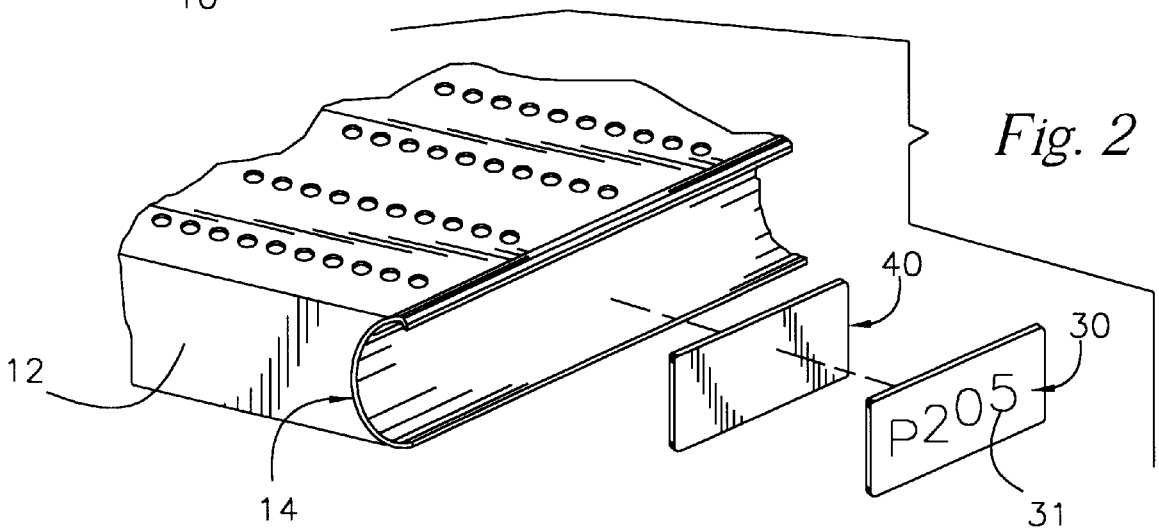
FIG. 2 is a perspective view of the support assembly of FIG. 1, with the label support liner and the label for placement thereon shown in exploded positions.
Figure 4:
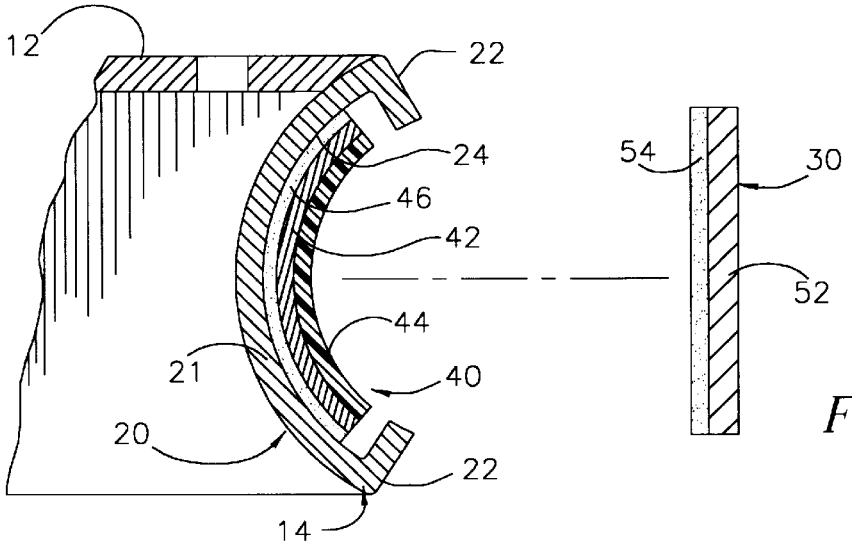
FIG. 4 is an enlarged somewhat schematic partial vertical sectional view taken generally at line 4—4 of FIG. 1 with a label in a detached position.
Figure 8:
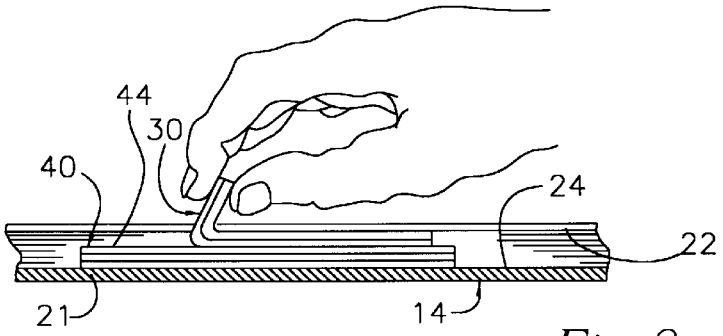
FIG. 8 is a top view which schematically illustrates the peeling removal of a label from the assembly of FIG. 1.

As indicated in FIG. 4, the label 30 typically includes a paper or synthetic stock body 52 carrying an appropriate adhesive 54 on one side and indicia printed or otherwise displayed on the opposite side; see indicia 31 indicated in FIGS. 1 and 2. The release layer 44 permits a previously mounted label 30 to be removed by peeling it off cleanly, with little effort and without leaving residue of the label adhesive 54 or portions of the label body 52 on the surface of the layer 44. Such a removal typically comprises raising a corner or edge, as with a fingernail, and pulling outward on the label, i.e. peeling it off by pulling on the freed edge in a direction generally away from the surface and progressively back over the attached portion of that label surface 28 as illustrated generally in FIG. 8. A liner 40 with a release coating 44 may be applied to the rail surface 24 at any time, e.g., by the manufacturer of the supports, or by a distributor or by a customer prior to or after installing the supports at a display site.

Figure 6:
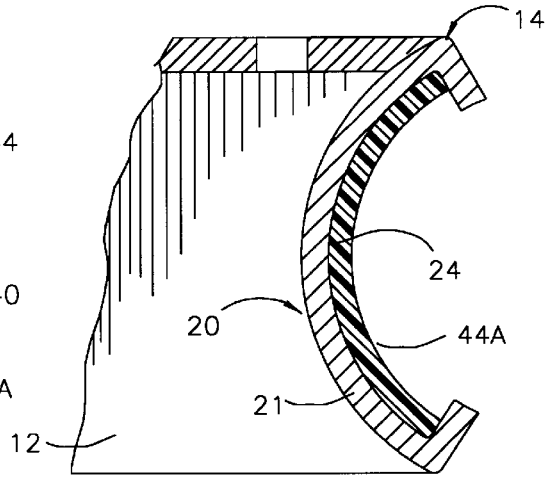
FIGS. 6 and 7 are sectional views similar to FIGS. 4 and 5 and showing other embodiments employing teachings of this invention.

In the embodiments illustrated in FIGS. 6 and 7, a release layer 44A, 44A' is applied as a coating directly on the respective label support panel, that is on the rail surface 24 in FIG. 6 and on the surface 24A of the end flange 20A of the shelf 12A in FIG. 7. An adhesive label 30 is mountable on and removable from the front exposed surface layer 44A, 44A' in the same manner noted in respect to the embodiment of FIG. 3.

The subject rails 14 may be formed of any suitable metal, synthetic plastic or similar material. The carrier body panel elements 42, 42B may be formed of paper stock or a synthetic material such as polyester, polyvinylchloride (PVC), polypropylene or polyurethane of suitable weight and stiffness or flexibility. One example is a 50# minimum bleached super calendar kraft (SCK) paper. A presently preferred example is a laminate of appropriate sheet materials, such as the laminate 242 illustrated in FIGS. 19–24 and described hereinafter.

The adhesive 46 may be any adherent material that is compatible with the materials of the supports 20, 20A and the carrier panel body 42 and which provides adherent strength (bond tensile strength) between the rail surface 24, 24A and the panel body 42 that is substantially greater than the adherent strength of the bond between the release layer 44 and the label adhesive 54. Examples of typical suitable adhesives 46 include rubber-based and acrylic adhesives, which may be pressure sensitive adhesives and may be the same as or different from the adhesive 54 of the labels 30. The release layer assures ready parting at the interface between the layer 44 and the adhesive layer 54 even if the adhesive 54 has the same or a higher bonding strength potential than the adhesive 46.

In each embodiment, the release layer or coating 44, 44A, 44A' preferably is a silicone material, i.e., contains a silicone and appropriate amounts of controlled release additives (CPA resins), which releasably supports labels 30 that use typical pressure sensitive adhesive layers 54. However, the release layer 44 may be formed of any material which will similarly retain an adhesively applied label in place while also assuring a sufficiently low adherent strength of the bond between the adhesive 54 and the layer 44, 44A, 44A' to permit the label to be easily and completely removed by peeling it from the support panel, normally as an integral element. It will be appreciated that this is a function of the tensile strength and tear resistance of the label as well as the adherence/release bonds between the label adhesive 54 and both the label body 52 and the release layer 44, 44A, 44'. To these ends a silicone material which includes a moderate amount of CRA and that provides a release value less than two pounds, preferably less than about one pound, and particularly about 20–160 grams, for labels 30 adhered thereto by rubber-based or acrylic pressure sensitive adhesives such as are commonly used on present-day pressure sensitive labels, has been found satisfactory for the practice of this invention. Such a silicone material provides secure retention of the labels while assuring convenient integral removal of the labels by the attendant personnel when desired. Further, these results are attained when using ordinary paper labels, which are much less expensive than labels of synthetic materials, and even when using so-called "freezer grade" acrylic pressure sensitive adhesive for the adhesive layer 54. The latter adhesive is preferred for its higher and reliable adherent capabilities under adverse conditions.

Figure 13:
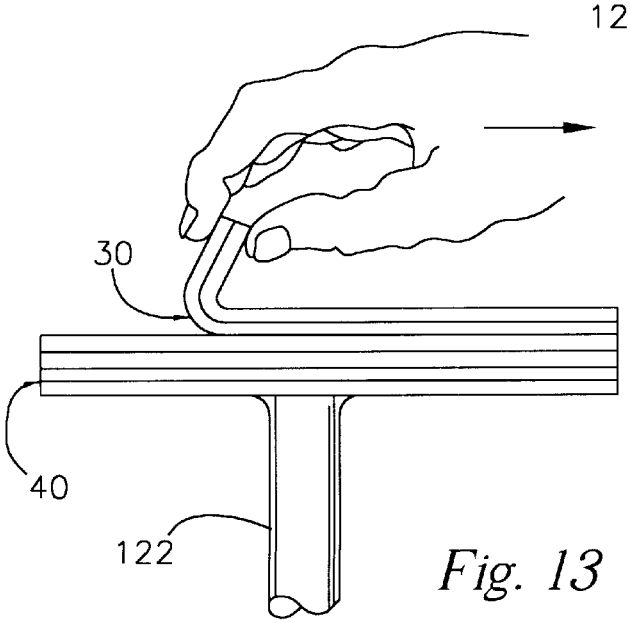
FIG. 13 is a top view which schematically illustrates the "peeling" removal of a label from the hanger assembly of FIG. 9.

One source of such a silicone material is Brown-Bridge Industries of Troy, Ohio. As used herein the term "release value" refers to the pulling force required to peel a 2" wide label from the release coating by pulling at 180° (parallel to the plane of the label, as illustrated generally in FIGS. 8 and 13) at 300"/min. by the standard Tag and Label Manufacturers Institute (TLMI) test method.

As indicated above, the label adhesive 54 typically is a pressure sensitive adhesive such as is commonly used on mailing labels and the like, e.g. rubber based or acrylic pressure sensitive adhesives. The adherent or tensile strength of the releasable bond between the release layer 44, 44A, 44A' and the adhesive 54 is substantially less than the bond of the adhesive 54 to the label body 52, and also substantially less than the bonds of the adhesive 46 to the carrier body 42 and to the surface 24,24A of the respective label support body 20,20A. Further, this releasable bond is substantially less than the tensile strength and tear strength of the label body 52, even when the label body 52 is a common paper label, and less than the delamination strength of the carrier body 42.

Figure 9:
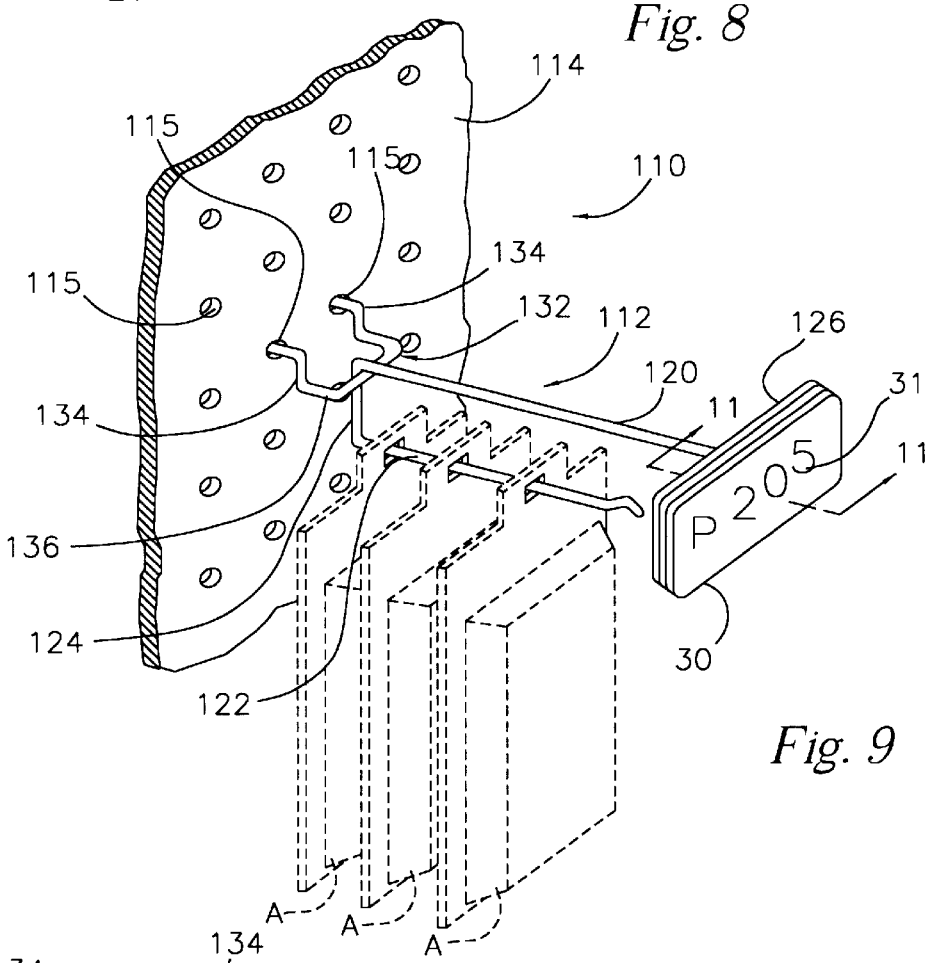
FIG. 9 is a perspective view of a typical display hanger assembly which employs teachings of the present invention, and illustrating a panel on which the hanger is mounted as well as merchandise supported on the hanger.
Figure 10:
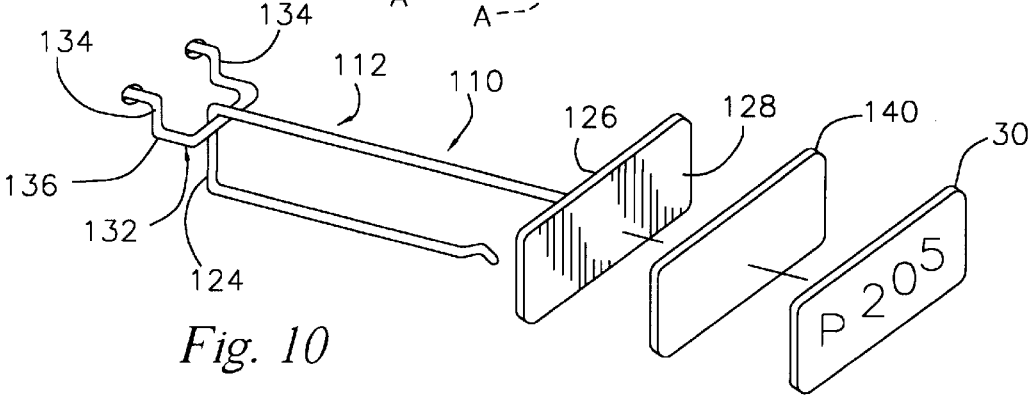
FIG. 10 is a perspective view of the hanger assembly of FIG. 9, with the label support liner and a label for placement thereon shown in exploded positions.
Figure 11:
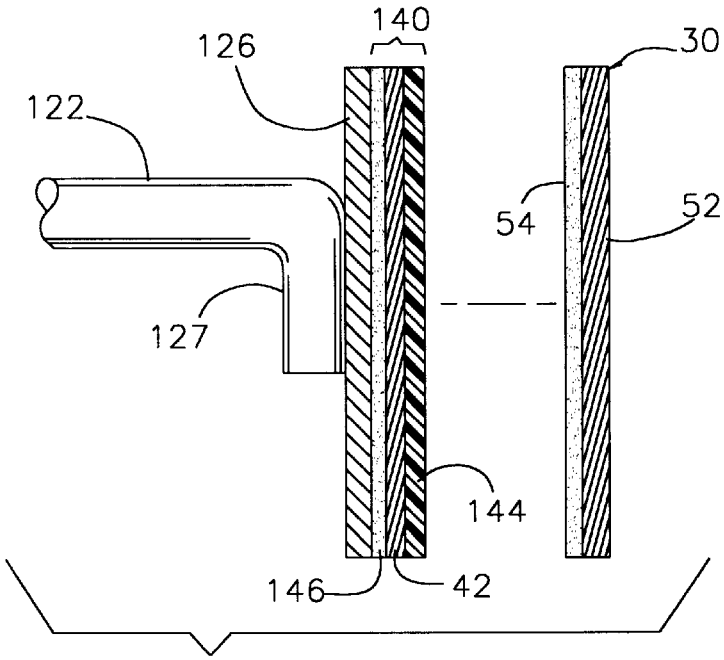
FIG. 11 is an enlarged somewhat schematic partial vertical sectional view taken generally at line 11—11 of FIG. 9 with the label in a detached position.

FIGS. 9–11 illustrate one preferred embodiment of the invention in connection with a hanger assembly 110. That assembly includes a product support hanger 112 for supporting one or more articles A from a panel or "Pegboard" 114 of the type formed with a series of vertically spaced and horizontally extending rows of holes 115. In this instance, the articles A are illustrated as bubble packages within which merchandise is contained. The upper end portion of each bag is formed with a hole to enable the bag to be hung from the hanger 112.

Herein, the product support hanger 112 is generally U-shaped and is made of a round rod or wire. The hanger includes upper and lower outwardly projecting generally horizontal arms 120 and 122 whose inner ends are formed integrally with and are joined by an upright connecting bight piece or connector portion 124. The lower arm 122 supports the articles A and often is referred to as the hanger arm. The upper arm 120 is often referred to as a scanner arm and carries a label support member 126 at its outer end. The illustrated support member 126 is a flat metal plate panel which is spot-welded to a vertical L-finger 127 on the inner end of the scanner arm 122; see FIGS. 11 and 12. However, the label support may have any of a variety of configurations and modes of attachment to the scanner arm and may be formed of various materials; see for example the hangers described and illustrated in the U.S. Pat. Nos. 3,912,084, 4,452,360, 4,783,033, 4,850,557, 4,976,058, 5,231,779, 5,236,163 and 5,325,616 which are incorporated herein by reference. Such hangers may be formed of different diameter wire or rods, e.g., relatively small diameter wires for light duty and heavier arms made of larger diameter wire for heavy duty, or arms of other cross-sectional configurations and/or other materials.

The label support panel member 126 presents an outwardly exposed generally planar surface 128 for supporting labels or other displays of readable information to passing customers and/or to merchandising personnel concerning the merchandise to be sold from the hanger 112. To this end, the member 126, and specifically its outwardly exposed surface 128, extends generally orthogonally relative to the longitudinal axis of the arm 120. Labels 30 or other display pieces are supported on the surface 128.

The hanger assembly 110 further comprises a suitable mounting or engagement section 132 at its rear end for removably mounting the hanger 112 on the panel 114. The section 132 includes generally L-shaped fingers or horns 134 for extending through the holes 115 through a panel 114 in a hook-like fashion whereby engagement of the fingers 134 in the holes 115 and with the rear surface of the panel, along with the concurrent abutment of the lower portion of bight 124 with the front face of the panel, supports the hanger 112 in its generally horizontal position. In the illustrated bracket, the fingers 134 are opposite ends of a U-shaped mounting rod element 136 that is affixed at the upper inner portion of the bight 124, as by spot welding. However, it will be appreciated that the mounting arrangement for supporting the bracket 112 on a pegboard or similar support fixture may be of a wide variety of configurations.

Figure 12:
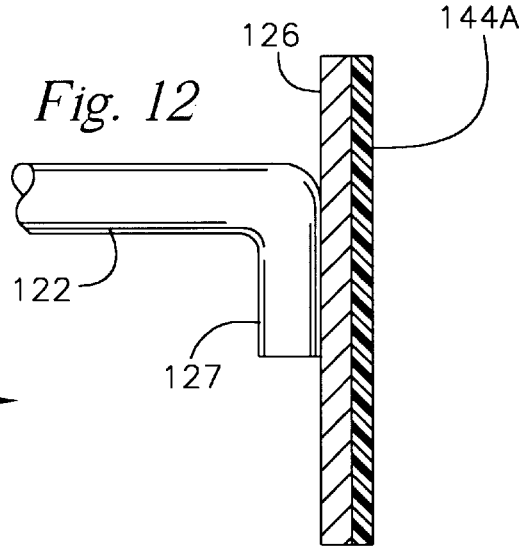
FIG. 12 is a sectional view similar to FIG. 11 and showing another embodiment employing teachings of this invention.

FIGS. 9–13 illustrate two embodiments for releasably and removably supporting display labels on the outer surface of label support plates 126, 126B in essentially the same manner as discussed above in reference to the embodiments 10 and 36 and particularly FIGS. 4–8. In FIG. 11, a liner 140 formed of a body 142 with adhesive 146 on one side and the release layer 144 on the opposite side is adhered to the support plate 126. In FIG. 12, a release coating layer 144A is applied and thereby directly bonded to the respective support plate 126. Thus, each embodiment presents a label support surface formed by a release coating 144, 144A, to facilitate the removal and replacement of synthetic or preferably paper adhesive labels 30. These release coatings have the same characteristics and are of the same materials as the release coatings 44, 44A, and 44A' discussed above.

Similar display members also may be used on other display supports, for example on fence-type shelving; see for example the above-cited U.S Pat. No. 5,231,779. As illustrated in that patent, such shelving includes a plurality of laterally extending parallel rods whose outer ends are connected by a rod extending longitudinally along the front edge of the shelf. In such instances, as in the aforenoted L-shaped scanner arms, the merchandise support includes rods or wires extending at right angles to one another at the outer edge of the support and to which a display support with an outer release layer may be attached as in the aforedescribed embodiments.

The aforedescribed release coating material may be applied to the respective designated surface areas by spraying, brushing or other coating techniques, and may be applied to entire shelves 12, 12A or supports 126 by dip coating if desired.

FIGS. 19, 20, 22, 23 and 24 illustrate embodiments with flexible label release liners 240, 240A each of which includes a carrier body 242 that is a laminate of flexible layers or sheets (lamina) 241 and 243 of differing materials. The laminae are joined to one another by an adhesive layer 241a. An adhesive layer 246 is bonded to the outward surface of the lamina 241 and a release layer 244 is bonded to the outward surface of the other lamina 243 in the same general manner as the corresponding layers of the liners 40 and 140 and using the same types of adhesive and release materials.

The respective lamina 241 and 243 preferably are chosen to provide a carrier body 242 having particular characteristics, such as in respect to the tensile and tear or delamination strength characteristics of the body 242 and the bonding characteristics provided on its outward sides. In this instance, the lamina 241 provides an outward surface which forms a strong uniform retentive bond with the adhesive layer 246. The lamina 243 is compatible with the manner of application of the release layer 244 thereto, e.g., heating during the application of a silicone release coating layer, and provides an outward surface which forms a strong uniform retentive bond with the release layer 244.

Figure 22:
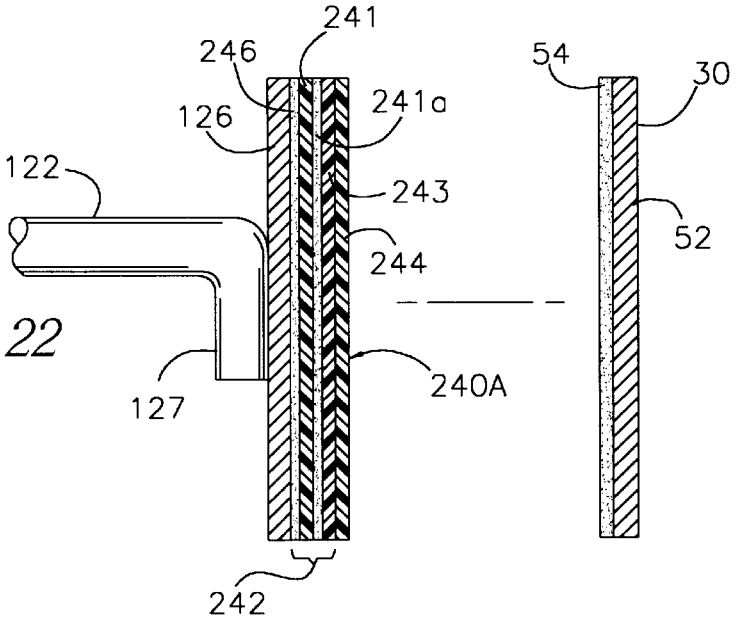
FIG. 22 is a sectional view similar to FIG. 11 illustrating another embodiment with a label liner corresponding to the liner of FIGS. 19 and 20.
Figure 23:
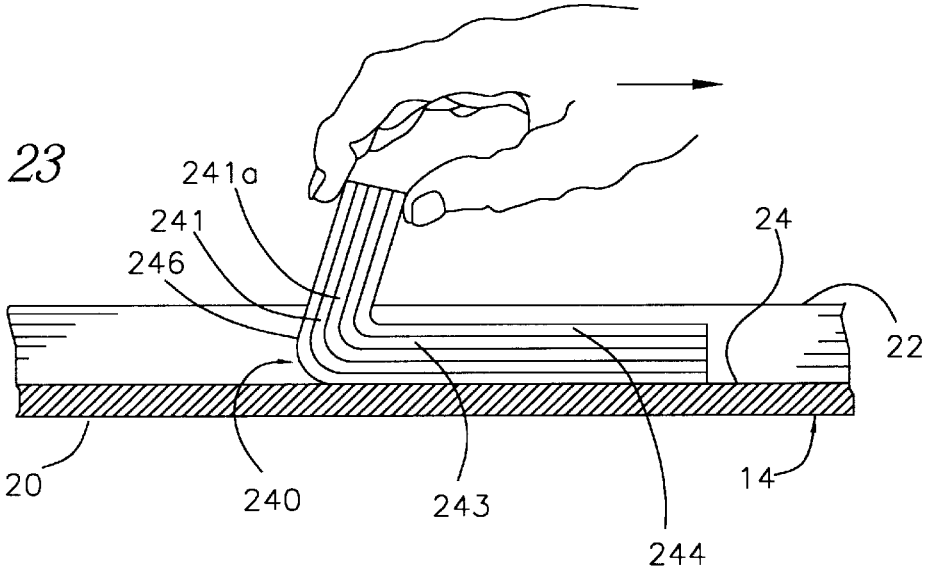
FIG. 23 is a top view, as seen generally along line 23—23 of FIG. 19, which schematically illustrates the peeling removal of a label liner embodying teachings of this invention from the surface of a merchandise support on which that liner was installed.

The bond provided between the layer 241 and adhesive 246 is significantly stronger than the bond of the adhesive 246 with the surface 24 of the merchandise support 20 (FIGS. 19, 21, 23) or the corresponding surface of support member 126 (FIG. 22). Further the tensile strength and the tear strength and delamination resistance of the body 242 also are substantially greater than the peel strength of the bond formed between the adhesive 246 and the support surface of the respective panel 20, 126. This noted tensile strength is provided by either or both of the laminae 241 and 243. However, the lamina 241 in particular has internal strengths by way of tear strength and delamination resistance greater than the peel strength of the bond between the adhesive 246 and the support surface of the respective panel. Thus, the liner 240, 240A may be attached to the respective panel support surface relatively permanently by the adhesive layer 246, in the same manner as the liners 40 and 140, and subsequently may be cleanly removed simply by peeling the liner 240, 240A off of that surface as illustrated in FIG. 23, leaving little or no residue of the liner, either by way of the adhesive or any part of the body 242, remaining on the panel surface. This permits easy replacement of any liner 240, 240A that deteriorates or is damaged as well as providing for complete removal of these liners in the event a proprietor decides to revise or change to a different labeling system, even after relatively long periods of installation and the attendant heat aging effects on the materials and the respective bonds.

Figure 24:
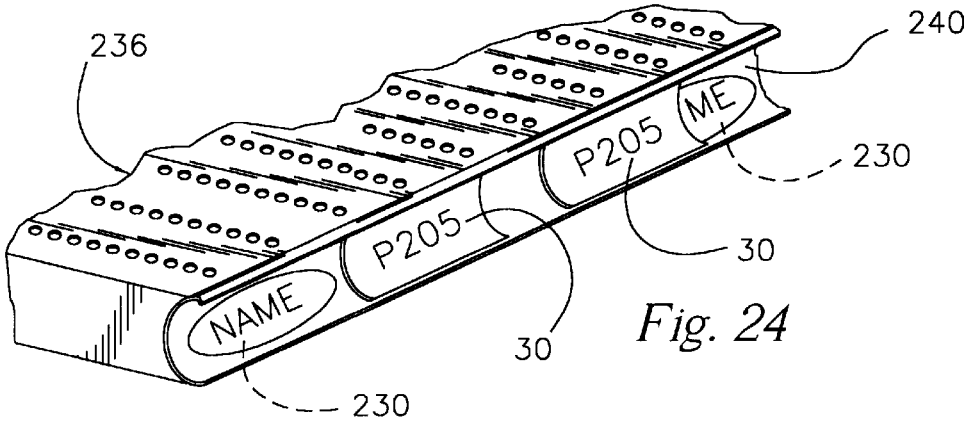
FIG. 24 is a perspective view similar to FIG. 3 illustrating another embodiment employing teachings of this invention.

The liners 240 may be of a length to extend continuously along the length of a price channel rail 14 as in FIGS. 3 and 24. Or they may be in shorter individual pieces 240A corresponding to the length of an individual label 30, as in FIG. 2, or to cover a support panel 126 to receive such a label on merchandise support hangers as in FIG. 22.

In addition to providing a strong reliable bond with the adhesive layer 246, the lamina 241 preferably is printable, such as to receive color coatings and/or informational or promotional indicia on its inward side. In addition to allowing for and providing a strong reliable bond with the release coating, the lamina 243 preferably is transparent, as are the adhesive 241*a* and the release coating 244. Thereby, either the color of the lamina 241 or a color coating applied to its inward surface will render the lamina 241 opaque and provide the apparent background color of the liner 240. This permits color determination and selection for the liner products as well as covering up markings, scars, residue or irregularities that may remain on a support surface 24 or the like over which the liner is applied. Further, relatively permanent information, such as advertising and promotional information may be preprinted on the inward side of the lamina 241 prior to lamination and thereafter be visible to passing customers in any areas of the liners 240 not covered by subsequently applied labels; see for example the logos as indicated at 230 in FIG. 24.

By way of one particular example, a satisfactory release liner 240 has been fabricated using an attaching adhesive and a release layer as described above with respect to the liner 40. The lamina 241 to which the adhesive 246 was applied is a vinyl, namely a 4 mil white semi-rigid vinyl marketed by the Flexcon company under the designation "Laser Film Select D-400-FWV-38". The lamina 243 to which the release layer 244 was applied was a biaxially oriented polypropylene (BOPP). A clear solvent acrylic adhesive 241*a* provided satisfactory lamination of these two laminae with the lamenating being affected by a flexographic operation.

Release liners 240 with laminate bodies 242 as described above have been found to be supple with good flexibility for easy application to label support surfaces of various merchandise supports without wrinkling.

Other materials, and particularly other synthetic plastics, are believed to be useful for forming the carrier bodies 42 and 242 of either a single layer (preferably transparent) or a laminate and attaining the described ready removability of the resulting release liners 40, 240 and 240A from the respective support surfaces, while retaining the ready removability and replaceability of labels thereon. For example, various polyesters have shown promise, some with surface pretreatments to enhance their bonding qualities with the release layer and/or with the attaching adhesive layer.

Figure 20:
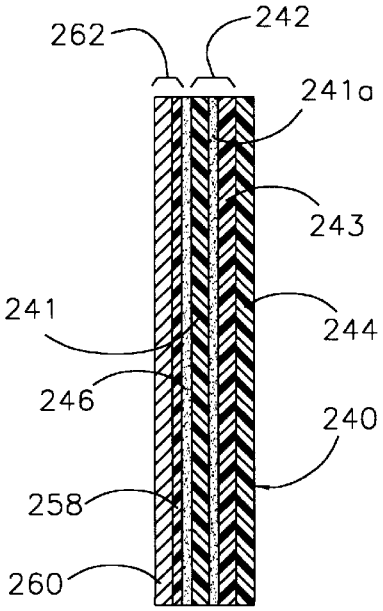
FIG. 20 is a schematic sectional view of a liner assembly which includes a label liner as in FIG. 19, with a protective carrier cover on the attachment adhesive.

FIG. 20 illustrates a liner strip 240 with a protective cover 262 temporarily attached over the adhesive layer 246 to protect the adhesive 246 during transportation and handling prior to use of the liner. The cover 262 consists of another carrier body layer 260 which carries a second release layer 258 firmly bonded thereto in the same general manner as described hereinafter with reference to FIG. 14. The cover 262 is removed prior to attachment of the strip 240 to a support surface such as at 24 or on a panel 126 and may be formed of relatively inexpensive materials.

FIG. 21 illustrates another preferred liner 240B for mounting on a support surface by sliding or snap-in engagement, such as by engagement with opposed lips 22, in the same manner as the carrier member 40B described above with reference to FIG. 6. The liner 240B includes a laminate carrier body with a release layer 244 as in the liner 240 but without an exposed adhesive attachment layer. In this embodiment the lamina 241 may be a stiffer material such as card stock to enhance mechanical interengagement with retainers such as the lips 22 and preferably is opaque and readily printable. The lamina 243 is compatible with the release layer, particularly with a silicone coating, and is transparent, as is the adhesive 241*a*. A liner 240 with the cover 262 remaining in place thereon as in FIG. 20 also may be used and mounted in the manner of the liner 240B in FIG. 21.

Figure 14:
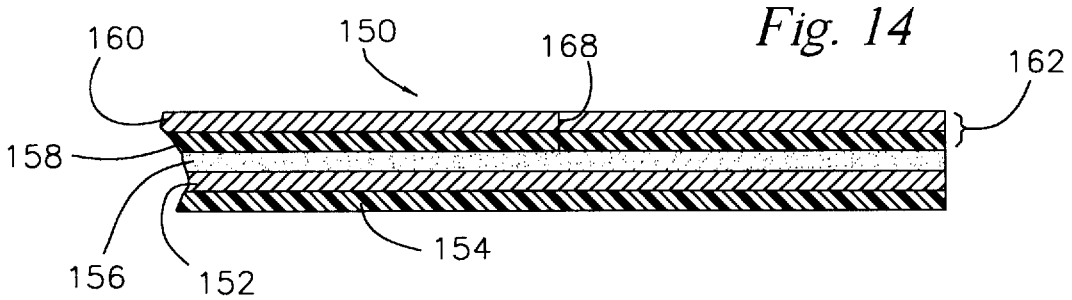
FIG. 14 is a cross-sectional view of label support liner stock as provided in sheet or strip form in accordance with teachings of this invention, e.g., an enlarged partial sectional view as taken along line 14—14 of FIG. 15.
Figure 15:
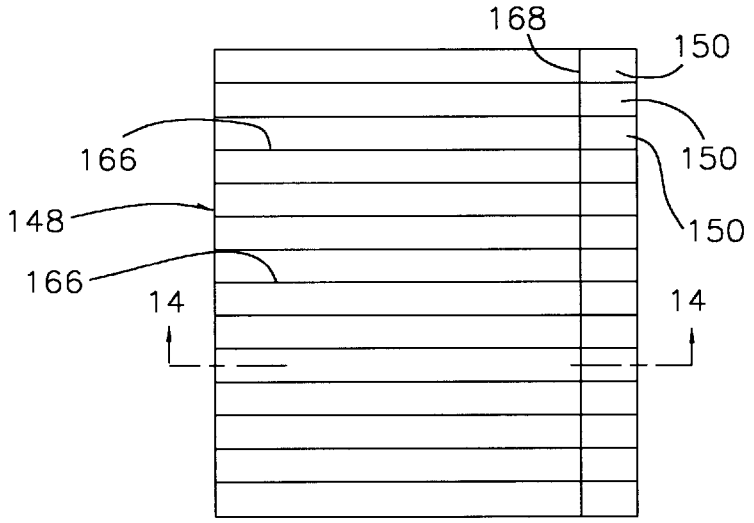
FIGS. 15 and 16 are plan views of two embodiments of multi-layer sheet stock material for providing a multiplicity of label support liners in accordance with teachings of this invention.
Figure 16:
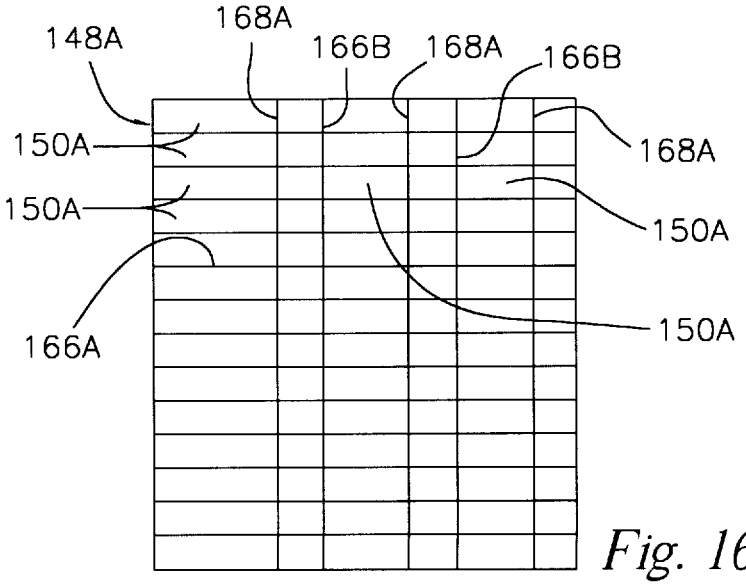
Figure 17:
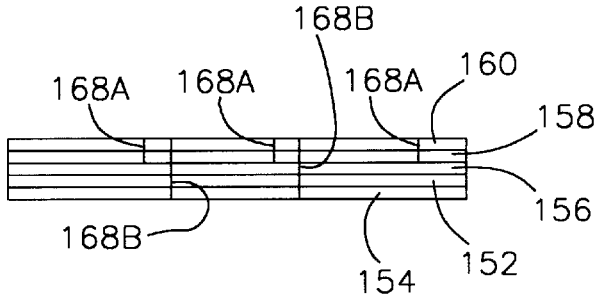
FIG. 17 is a schematic end view of the sheet assembly of FIG. 16.
Figure 19:
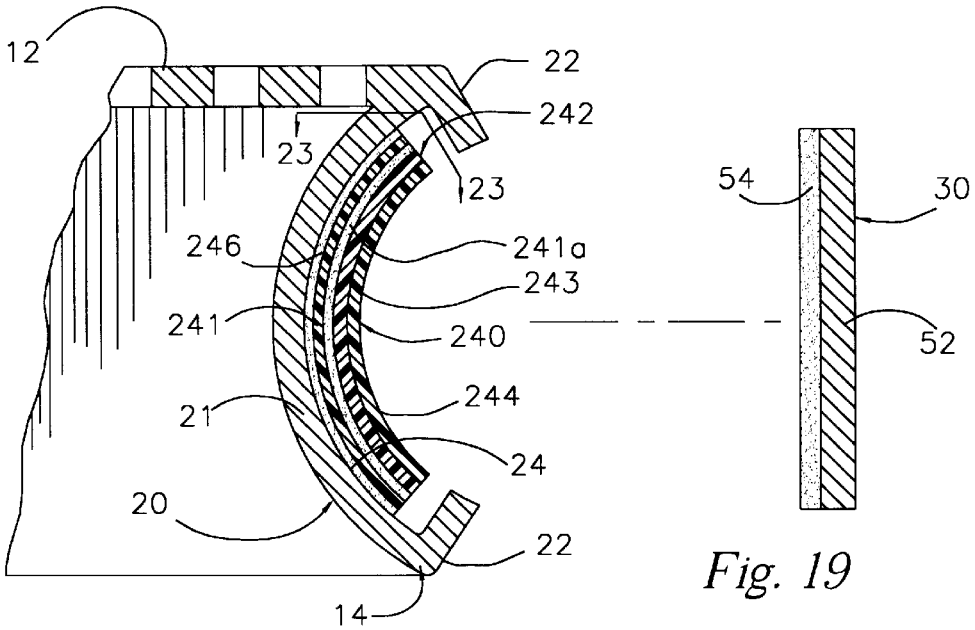
FIG. 19 is a sectional view similar to FIG. 4 illustrating another embodiment employing teachings of this invention.

The release liners 40,40A,140,240,240A may be supplied to users in flexible sheet or strip form, such as in rolls, for on-site application to merchandise supports by the users. Examples of such products are illustrated in FIGS. 14–18. FIGS. 14 and 15 illustrate multi-layer sheet stock 148 which is scored to provide a plurality of liner assemblies 150 for forming strip liners such as the liners 40A of FIG. 3 and 240 of FIG. 24. For example, such strips may be about 1¼" wide and 47¾" long for use on price channel rails 14 or other merchandise supports based upon 48" modular widths. FIGS. 16 and 17 illustrate similar sheet stock 148A scored for forming liners such as the individual label liners 40 and 240A.

Figure 18:
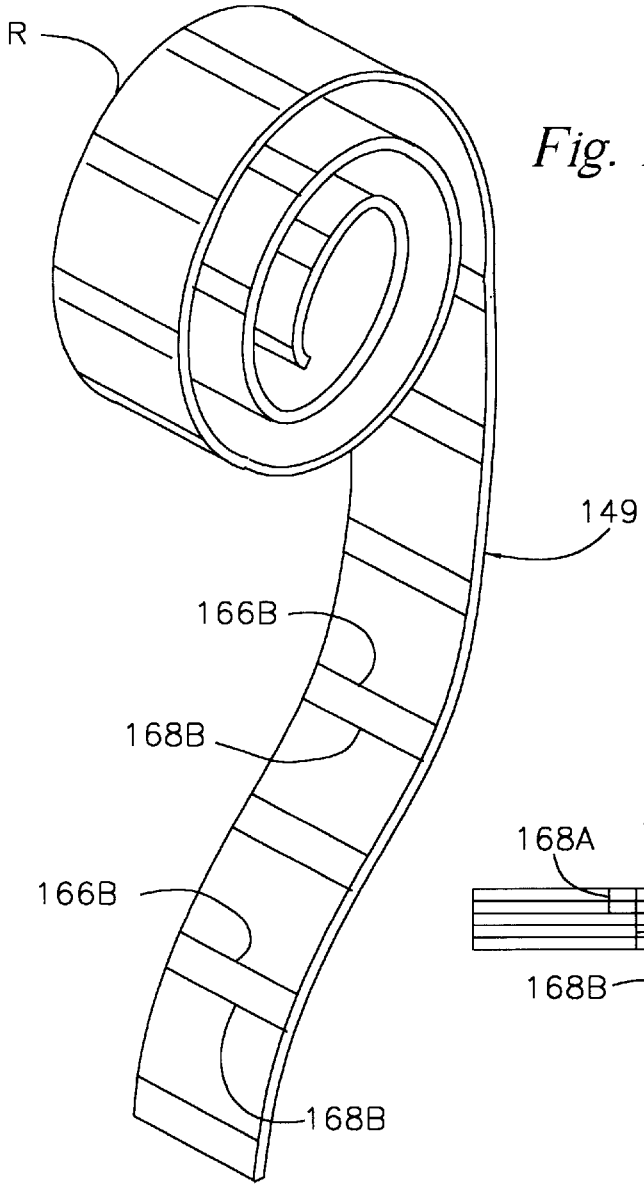
FIG. 18 is a partially perspective and partially plan view of similar multi-layer material provided in strip form.

FIG. 18 illustrates similar sheet stock 149 in strip form, that may be supplied in rolls, and scored for forming release liners of any predetermined length, e.g., for forming liners 40, 40A, 240 or 240A. Each such liner assembly 148,148A, 149, 150 includes a carrier body layer 152, a release layer 154, an adhesive layer 156, a second release layer 158 and a second carrier body 160. The body layer 152 is of the same material as body layers 42 and 142 or a laminate 242 such as described above. The release layer 154 is of the same materials as the release layers 44, 144 and 244 described above. The adhesive layer 156 is of the same materials as the layers 46, 146 and 246 described above. The second carrier body layer 160 may be of the same material as the carrier body layer 152 or of a different material and carries the second release layer 158 firmly bonded thereto to form a protective cover layer 162 for the adhesive layer 156. The second release layer 158 is similar to the release layer 154 but may have a lesser release value whereby the protective cover layer 162 is readily removable to expose the adhesive 156.

The entire assembly 148 of FIG. 15 preferably is provided with transverse scores as at 166 at appropriate spacings to define individual strips for forming liners such as liners 40A or 240 by tearing or cutting along the scores. Additional cuts or tab edges may be provided through the cover layer, as at 168, to facilitate removal of each corresponding cover segment when the respective liner segment is to be applied to a support. The assembly 148A of FIGS. 16 and 17 is similarly scored along transverse lines 166A and longitudinal lines 166B to define shorter segments 150A for forming release liners 40 or 240A. The assembly 148A also includes multiple cut lines 168A through the cover layer 162 to provide cuts or tabs for removing this layer from the individual liner segments.

The stock assembly 149 of FIG. 18 provides similar liner assemblies in a narrow strip form of a width corresponding to the desired liner width and of indeterminate length. The multi-layer strip 149 preferably is supplied in rolls R as illustrated. The assembly is provided with transverse scores 166B therethrough at predetermined spacings corresponding to the desired lengths of individual liner strip segments. Transverse cuts or tabs also may be provided in the cover layer, as at 168B, for convenient removal of the respective cover layer segments. The strip 149 should be maintained in lateral alignment in the roll during use, to prevent "telescoping" of the coils along the axis of the roll. This may require lateral constraints, such as by placing the roll R in a dispensing container of appropriate width or providing the roll on a flanged spool. In the roll form, the cover layer 162 also may be omitted. The coiling places the outer surface of the release layer 154 of each coil adjacent the adhesive layer 156 of an adjacent coil. Therefore the release layer 154 may be relied upon for providing suitable protection for the adhesive 156 in the roll R while adhering thereto adequately for maintaining the roll coils in lateral alignment during use and providing easy parting as the roll is uncoiled.

From the foregoing it can be seen that display supports have been provided which accomplish the aforenoted objects of this invention.

It will be understood that other variations, modifications and substitutions of equivalent configurations can be effected within the spirit and scope of this invention, particularly in light of the foregoing teachings. It is contemplated by the following claims to cover any such modifications and other embodiments that incorporate those features which constitute the essential features of the invention within the true spirit and scope of the following claims.

What is claimed is:

1. A method of maintaining current merchandising labels in association with merchandise carried on a merchandise display support having associated therewith a merchandise label supporting surface and also facilitating changes in the manner by which such labels are maintained in association with merchandise on said display support, the method comprising the steps of:

providing a release liner which includes a carrier layer with an adhesive layer bonded on one side and a label release surface on the opposite side;

bonding said liner to said label supporting surface by said adhesive layer with said label release surface exposed as an exterior surface to which labels may be applied, the label release surface having a characteristic which causes adhesive labels to adhere thereto, when said labels are applied, but which allows such adhesive labels to be peeled cleanly from the label release surface without substantial tearing or delamination of the labels;

applying an adhesive label bearing current merchandising information to said label release surface for characterizing the merchandise carried on the merchandise display support;

when the merchandise or the merchandise characteristics change, peeling said adhesive label from said label release surface and applying a new adhesive label thereto bearing updated merchandising information;

repeating said last mentioned step each time the merchandising information changes using a plurality of successive updated adhesive labels which are similarly released, when needed, by said label release surface;

said adhesive layer being bonded to said one side of said carrier layer more strongly than to said label supporting surface of said support; and said carrier layer having a tensile strength and a tear strength that exceed the release value of the adherent bond between said adhesive layer and said label supporting surface, whereby said release liner may be peeled from said label supporting surface intact with said adhesive layer remaining adhered to said carrier layer and thereby being substantially completely removable from said label supporting surface with said carrier layer upon such peeling removal of said release liner.

2. A method as in claim 1 including providing said carrier layer as a lamination having two opposite sides, including a layer of a first sheet material forming said one side of said carrier layer and which forms a strong bond with said adhesive layer, a layer of a second material different from said first sheet material and forming said opposite side of said carrier layer, and a release layer strongly bonded to said second material and providing said release surface.

3. A method as in claim 2 including forming a bond between said first sheet material and said adhesive which is significantly stronger than the bond of said adhesive to said label supporting surface, and said first sheet material having tear and delamination strengths greater than the bond between said adhesive and said label supporting surface, whereby said adhesive will remain adhered to said first sheet material and be removed from said label supporting surface upon peeling of said carrier layer from said label supporting surface.

4. A method as in claim 3 wherein said first sheet material is formed of a vinyl.

5. A method as in claim 3 wherein said second sheet material is transparent.

6. A method as in claim 3 wherein said second sheet material is formed of a biaxially oriented polypropylene.

7. A method as in claim 1 wherein said merchandise display support is a merchandise support shelf, and wherein said label supporting surface is on an exposed edge surface of said shelf.

8. A method as in claim 1 wherein said merchandising display support is a merchandise support hanger which includes a scanner arm with a label support member on its outer end, and wherein said label supporting surface is on an exposed surface of said label support member on said scanner arm.

* * * * *